US006521043B1

(12) United States Patent
Spatafora

(10) Patent No.: US 6,521,043 B1
(45) Date of Patent: Feb. 18, 2003

(54) DEVICE FOR CLEANING A GUMMING APPLICATOR

(75) Inventor: Mario Spatafora, Bologna (IT)

(73) Assignee: G. D S.p.A., Bologna (IT)

( * ) Notice: Subject to any disclaimer, the term of this patent is extended or adjusted under 35 U.S.C. 154(b) by 26 days.

(21) Appl. No.: 09/763,960

(22) PCT Filed: Jun. 29, 2000

(86) PCT No.: PCT/IB00/00877

§ 371 (c)(1),
(2), (4) Date: Feb. 28, 2001

(87) PCT Pub. No.: WO01/02101

PCT Pub. Date: Jan. 11, 2001

(30) Foreign Application Priority Data

Jul. 2, 1999 (IT) ..... BO99A0364

(51) Int. Cl.[7] ..... B05C 11/06

(52) U.S. Cl. ..... 118/63; 118/70; 118/203; 118/249; 118/259; 15/256.51; 15/316.1; 15/345; 15/346

(58) Field of Search ..... 118/63, 70, 203, 118/249, 259; 156/578; 15/256.51, 316.1, 301, 345, 346; 427/207.1, 348

(56) References Cited

U.S. PATENT DOCUMENTS 3,455,728 A * 7/1969 Kiwiet ..... 118/314
4,210,977 A * 7/1980 Lillibridge ..... 118/203
5,221,350 A 6/1993 Vuilleumier et al.
5,505,776 A 4/1996 Pichler et al.
5,567,481 A 10/1996 Yu et al.
5,603,775 A * 2/1997 Sjoberg ..... 134/122 R
5,944,956 A * 8/1999 Marcheggiani ..... 15/345
6,033,513 A * 3/2000 Nakamura ..... 118/211

FOREIGN PATENT DOCUMENTS

DE 197 02 364 4/1998

OTHER PUBLICATIONS

Patent Abstracts of Japan, vol. 018, No. 219 (C–1192), Apr. 20, 1994, & JP 06 015207, Jan 25, 1994.

* cited by examiner

*Primary Examiner*—Laura Edwards
(74) *Attorney, Agent, or Firm*—The Law Offices of Timothy J. Klima

(57) ABSTRACT

A gumming applicator (1) rotatable about a central axis (A) is cleaned by a device (4) comprising a nozzle (13) connected to a source (11) of pressurized fluid (50) and calibrated so as to deliver an atomized jet (14) which is directed at the gumming applicator (1) to the end of removing residues (60) of the gumming adhesive (2) from the applicator (1); the nozzle (13) is also capable of movement in a direction (D) parallel with the axis (A) of rotation of the applicator (1).

10 Claims, 4 Drawing Sheets

1
12
11
39
32
A
13
14
4
8
38
15
50
IV
IV
36
34
60
49
3
44
45
42
48
46
21
18
41
43
42
20
17
47
37

DEVICE FOR CLEANING A GUMMING APPLICATOR

This application is the national phase of international application PCT/IB00/00877 filed Jun. 29, 2000 which designated the U.S.

TECHNICAL FIELD

The present invention relates to a device for cleaning a gumming applicator.

The invention finds application advantageously in association with mechanisms by which adhesive substances are applied to sheet materials as used in manufacturing and packaging machines for the tobacco industry, the art field to which explicit reference is made in the following specification albeit with no limitation in scope implied.

BACKGROUND ART

It is the practice when using machines of the type in question for sheet materials to be gummed by relative applicator mechanisms typically of roller or double disc design.

With a roller type gumming applicator, the adhesive substance is fed directly onto the outer surface of revolution presented by the roller; the surface can be completely smooth so that the adhesive substance is distributed continuously, or indented, affording a plurality of cells by which the adhesive is taken up and distributed in dabs.

Generally speaking, a roller type applicator picks up the adhesive substance directly from a tank in which the gumming roller itself is partly immersed, or alternatively the roller can be supplied with the adhesive substance by a feed device delimited on one side by a substantially cylindrical surface directed toward the surface of revolution of the gumming roller.

In the case of the double disc type applicator, this appears substantially as a pair of coaxially disposed discs identical in diameter, driven in rotation as one and combining to create a central cavity connected externally with the surrounding space by way of delivery slits formed between the discs, and internally with a tank containing the adhesive substance, which is fed under pressure to the central cavity.

One of the main drawbacks experienced with all gumming applicators of the types summarized above is that the adhesive substance used for gumming the sheet material tends to collect on the applicator, generating unwanted accumulations especially at the point of distribution and consequently jeopardizing a correct application of the selfsame substance on the sheet material. Moreover, adhesive substances of the type in question are quick-drying, so that any pause during the operating cycle of the machine with which the gumming applicator is associated, however short, can produce additional accumulations and encrustations which then need to be removed.

Conventionally, roller type gumming applicators are also equipped with a doctor blade positioned at a point preceding the gumming area in the direction of rotation of the roller and riding substantially in contact with the surface of revolution, of which the function, in the case of a completely smooth roller, is to spread the adhesive substance evenly along the length of the revolving surface.

More precisely, in the event that the gumming applicator consists in a roller indented with a plurality of cells destined to receive the adhesive substance, the doctor blade serves both to direct the adhesive into the cells and also to remove the excess adhesive from the inactive surface of the roller not occupied by the cells.

It will be clear however that in performing its principal function as a flow control element, the doctor blade cannot ensure an effective cleaning action either when associated with a roller having a completely smooth face or, in particular, when associated with a roller having an indented face. It follows therefore that the adhesive substance tends to accumulate during each successive gumming cycle, whether on a smooth surface or in the cells of an indented surface, generating residues which impact negatively on the operation of the gumming applicator and must be removed, so that frequent stoppages for cleaning are required.

The problem in question is most noticeable in the case of a double disc type gumming applicator. Indeed with this particular design of applicator it is the discs themselves that control the flow of the adhesive substance and a doctor blade would be incorporated solely in order to perform a cleaning function, which in any event would be ineffective as there is no way that the edge of the blade could wipe the slits in the gumming applicator from which the adhesive substance emerges.

A further drawback deriving from the use of doctor blades as cleaning elements is that residues of the adhesive substance tend inevitably to build up on the blade itself in the course of its inter-action with the gumming applicator. Consequently, frequent interruptions are dictated similarly by the need to remove these accumulations from the surface of the doctor blade.

The object of the invention is to provide a device for cleaning any type of gumming applicator, such as will remove residues of adhesive substances in an effective manner while remaining free of the drawbacks described above.

DISCLOSURE OF THE INVENTION

The stated object is realized in a device according to the present invention for cleaning a gumming applicator, which comprises a source of pressurized fluid and at least one nozzle connected to the source, producing at least one jet of pressurized fluid by which a gumming applicator is invested when in operation in such a way as to remove residues of an adhesive substance from the selfsame gumming applicator.

BRIEF DESCRIPTION OF THE DRAWING

The invention will now be described in detail, by way of example, with the aid of the accompanying drawings, in which.

Figure 1:
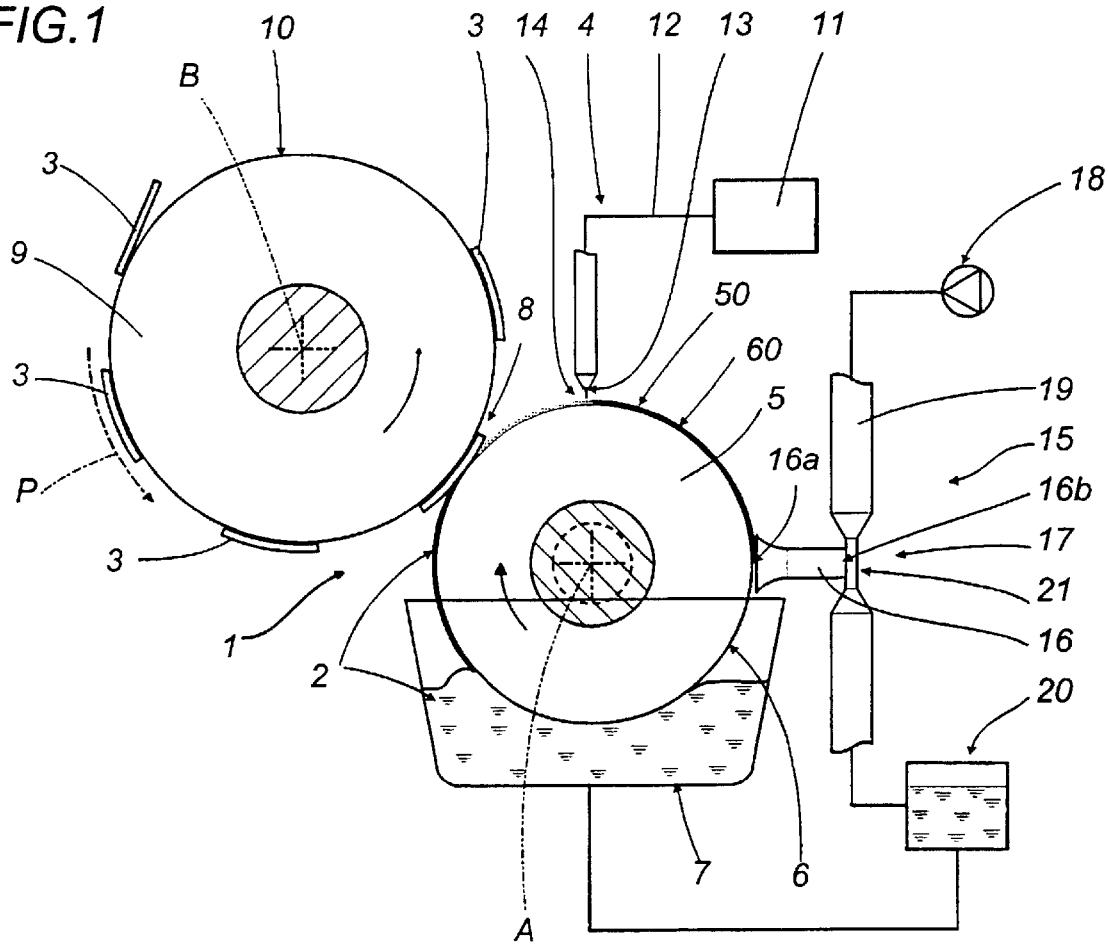
FIG. 1 is a schematic diagram showing a gumming applicator, with certain parts omitted and others seen in section, illustrated in a first embodiment and equipped with a cleaning device according to the present invention.

Referring to the drawings, 1 denotes a typical gumming applicator in its entirety, rotatable about a relative axis A, by which an adhesive substance 2 is applied to a sheet material 3, whilst 4 denotes a device, in its entirety, for cleaning the gumming applicator 1.

Figure 1A:
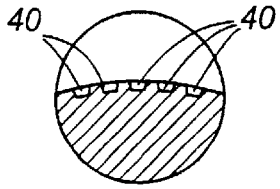
FIG. 1*a* is a detail of FIG. 1, shown in section.

In the example of FIG. 1, the applicator 1 consists in a gumming roller 5 with a peripheral gumming surface 6 of substantially cylindrical geometry that affords a plurality of peripheral cells 40 (indicated in FIG. 1*a*) designed to pick up the adhesive substance 2 from a tank 7 in which the roller 5 is partially immersed.

The gumming roller 5 is set in rotation about the axis A, turning clockwise as seen in FIG. 1, in such a way that the peripheral surface 6 passes through a gumming station 8 located downstream of the tank 7 in the direction of rotation revolving tangentially to a suction roller 9 rotatable about a relative axis B parallel to the axis A first mentioned and in the opposite direction to the gumming roller 5.

The sheet material 3 is advanced by the suction roller 9 along a path P coinciding substantially with the peripheral surface 10 of the roller 9, and caused thus to pass through the gumming station 8 where it receives the adhesive substance 2 from the peripheral cells 40.

The cleaning device 4 is located beyond the gumming station 8, relative to the direction of rotation followed by the roller 5, and comprises a source 11 of pressurized fluid 50, illustrated schematically in the drawings, connected by way of a pipeline 12 to a nozzle 13 from which a relative jet 14 of the pressurized fluid 50 is projected at the gumming roller 5 in a substantially radial direction.

The gumming surface 6 of the roller 5 is struck by the jet 14, with the result that the residues 60 and encrustations of the adhesive substance 2 which form on the selfsame surface 6 are removed.

The cleaning device 4 includes a collection device 15 comprising a duct 16 of which an open inlet end 16*a* is offered to the peripheral surface 6 of the roller 5 in such a way as to pick up the fluid 50 and the residues 60 of adhesive removed by the jet 14, and an outlet end 16*b* is connected to aspirating means denoted 17 in their entirety. The aspirating means 17 comprise a source 18 of pressurized gas connected by way of a first blower duct 19 to a holding tank 20 in which the adhesive substance 2 is collected. The first blower duct 19 presents a restriction 21 designed to create a depression in the selfsame duct 19, and is connected to the aforementioned outlet end 16*b* of the duct 16.

In operation, when the gumming roller 5 is set in rotation about its axis A, a certain quantity of the adhesive substance 2 clings to the peripheral surface 6 of the gumming roller 5, filling the aforementioned cells 40. The adhesive substance 2 is transferred at the gumming station 8 from the cells 40 to the sheet material 3, but because all of the adhesive substance 2 occupying the cells 40 will not always be used up completely during the transfer step, it happens that encrustations and accumulations of the adhesive substance 2 tend to collect in the cells 40 during successive gumming cycles.

The cleaning device 4 will come into operation at predetermined intervals and invest the external surface 6 of the gumming roller 5 with a jet 14 of pressurized fluid 50, which emerges substantially atomized from the nozzle 13, given that the nozzle orifice is of micrometric dimensions and the fluid is supplied from the source 11 at high pressure. In this way the jet 14 strikes the encrustations and the accumulated adhesive substance 2, generating the aforementioned residues 60.

The nozzle 13 is also capable of movement from one end of the roller 5 to the other in such a way that the entire axial length of the peripheral gumming surface 6 can be invested by the jet 14 and cleaned effectively.

The fluid 50 along with the residues 60 of the adhesive substance 2 struck by the jet 14 are drawn forcibly into the collection device 15, through the agency of the action generated by the aspirating means 17. In effect, the restriction 21 creates a depression in the first blower duct 19 by which the fluid 50 and the adhesive residues 60 are drawn into the duct 16 through the open inlet end 16*a* and then by way of the outlet end 16*b* into the blower duct 19 itself; the resulting stream is directed into the holding tank 20, which is connected in its turn to the dip tank 7.

Given that the jet 14 emerges at high pressure, a relatively small quantity of fluid 50 is enough to bring about an effective cleaning action on the surface 6, and, considering also that the cleaning operation is performed intermittently, the mixture of the fluid 50 and the adhesive residues 60 can be returned to the dip tank 7 without significantly altering the rate at which the adhesive substance 2 is diluted.

Figure 2:
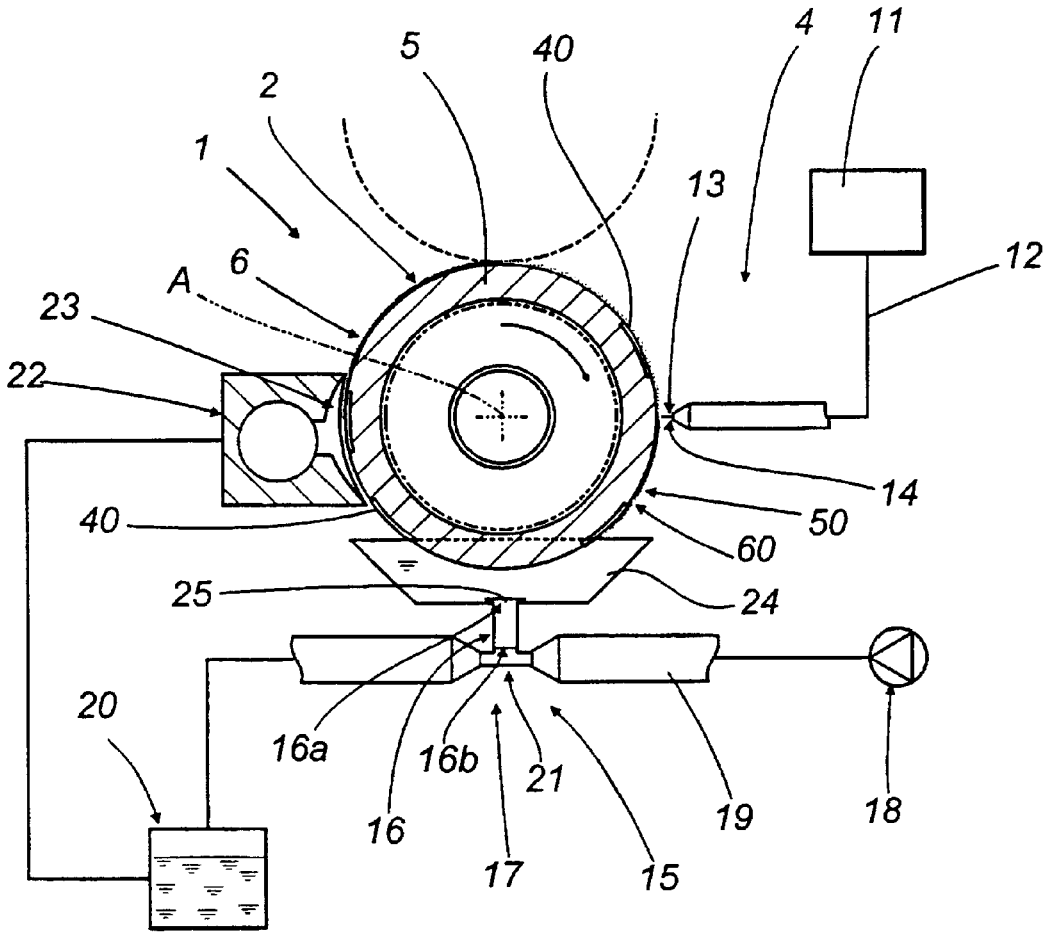
FIG. 2 is schematic diagram showing a gumming applicator, with certain parts omitted and others seen In section, illustrated in a second embodiment and equipped with a cleaning device as in FIG. 1.

Referring to FIG. 2, the gumming applicator 1 comprises a gumming roller 5, and a feed device 22 by which the adhesive substance 2 is supplied to the peripheral surface 6 of the roller 5. The feed device 22 is delimited on the side directed toward the gumming roller 5 by a concave surface 23 of substantially cylindrical geometry breasted with the peripheral gumming surface 6 of the roller 5. In this embodiment, the adhesive substance 2 is transferred from the cylindrical surface 23 to the peripheral gumming surface 6 of the roller 5.

In the example of FIG. 2, the collection device 15 comprises a tank 24 positioned so as to catch the fluid 50 and the adhesive residues 60 dislodged from the roller 5 by the action of the jet 14.

The tank 24 has a bottom outlet 25 coinciding substantially with the aforementioned open inlet end 16*a* of the duct 16, through which the fluid 50 and the residues 60 are directed as in the example of FIG. 1, and in this instance, likewise, the duct 16 presents an outlet end 16*b* connected to the restriction 21 of the first blower duct 19; again as in FIG. 1, the duct 19 in question forms part of aspirating means 17 serving to convey the fluid 50 and the adhesive residues 60 to a holding tank 20 connected in turn to the feed device 22.

Figure 3:
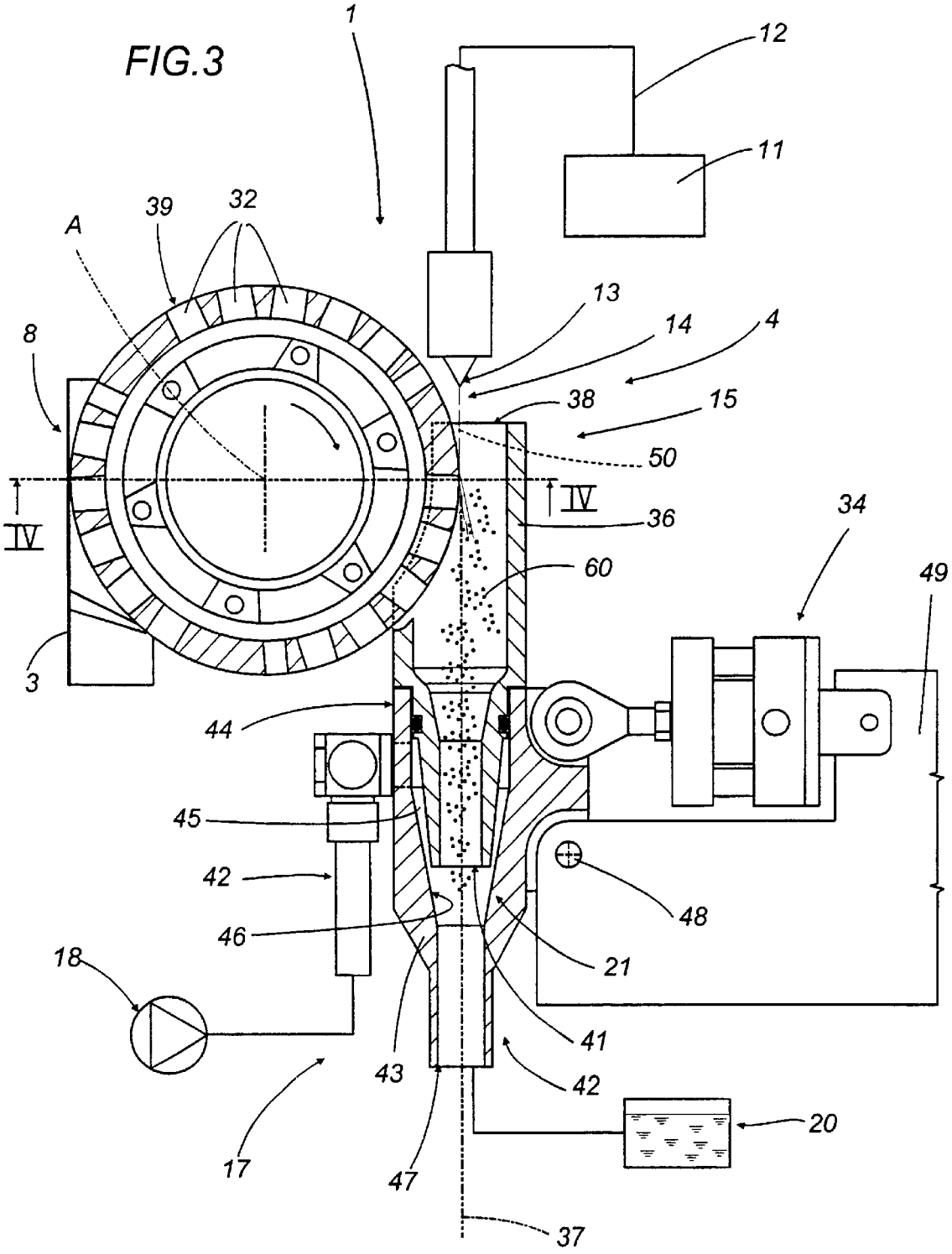
FIG. 3 is a schematic side elevation of a gumming applicator, with certain parts omitted and others seen in section, illustrated in a further preferred embodiment and equipped with a respective cleaning device.
Figure 4:
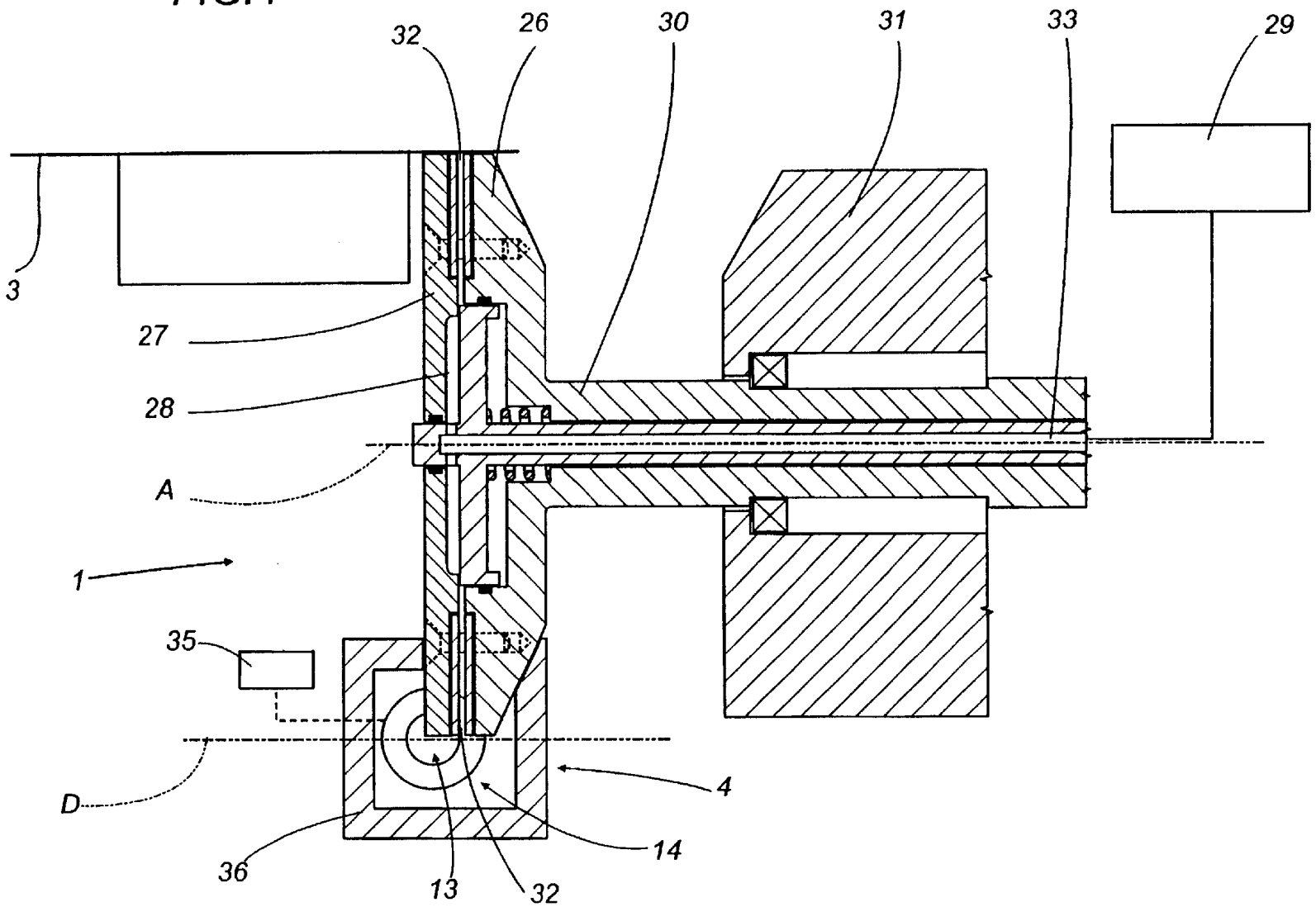
FIG. 4 is a section through IV—IV in FIG. 3.

FIGS. 3 and 4 show a preferred embodiment in which the cleaning device 4 is associated with a gumming applicator 1 of the type comprising a pair of discs, effectively an internal disc 26 and an external disc 27 coaxially disposed and identical in diameter, between which a central cavity 28 is formed.

The internal disc 26 of the pair is keyed onto a shaft 30 mounted to a frame 31 and rotatable thus about its own axis A in a clockwise direction as seen in FIG. 3 through the agency of conventional drive means (not illustrated). The external disc 27 is rigidly associated with the internal disc 26, so that the two rotate as one.

The cavity 28 communicates with the surrounding space by way of delivery slits 32 formed between the two discs 26 and 27 and receives the adhesive substance 2 under pressure from a tank 29 by way of a duct 33 coaxial with the shaft 30.

Charged with centrifugal force generated by the continuous rotation of the discs 26 and 27 about the axis A and the supply pressure maintained in the tank 29, the adhesive substance 2 is propelled through each of the slits 32 and directed onto the sheet material 3 at a gumming station 8.

The cleaning device 4 is located beyond the gumming station 8, relative to the direction of rotation followed by the gumming applicator 1, and comprises the source 11 of pressurized fluid 50 connected by way of a pipeline 12 to a nozzle 13. The jet 14 of pressurized fluid 50 in this case is projected in a direction substantially tangential to the gumming applicator 1.

The collection device 15 in the example of FIGS. 3 and 4 comprises a first tubular body 36 extending along a substantially vertical axis 37, of which an open inlet end 38 is directed toward the peripheral surface 39 of the gumming applicator 1 afforded by the circumferential edges of the discs 26 and 27, and serves to gather the fluid 50 and the adhesive residues 60 removed from the selfsame surface 39.

The same first tubular body 36 affords an outlet end 41 connected to aspirating means 17 of the type indicated in FIGS. 1 and 2, comprising a source 18 of pressurized gas connected by way of a relative second blower duct 42 to a holding tank 20 in which the adhesive substance 2 is collected.

As discernible from FIG. 3 in particular, the second duct 42 comprises a second tubular body 43 of which a first end 44 is coupled externally to the outlet end 41 of the first tubular body 36 in a fluid tight fit and in such a way as to create a substantially annular chamber 45 encircling the outlet end 41, presenting a frustoconical portion 46 that tapers toward a second end 47 of the second tubular body 43 connected to the tank 20.

Similarly to the embodiments of FIGS. 1 and 2, the frustoconical portion 46 serves to establish a restriction 21 in the blower duct 42.

By virtue of the blowing action produced at the source 18, the stream of pressurized gas is caused to accelerate through the frustoconical portion 46 constituting the restriction 21, thereby creating a depression strong enough to draw the fluid 50 and the adhesive residues 60 through the outlet end 41 of the first tubular body 36.

The collection device 15 is anchored by way of a pivot 48 to a frame 49 and rendered capable thus of movement, induced by actuator means 34, between a first operating position illustrated in FIG. 3, in which the open end 38 of the first tubular body 36 is brought close to the gumming applicator 1 so as to take up the fluid 50 and the residues 60, and a second idle position, not illustrated, in which the selfsame open end 38 of the first tubular body 36 is distanced from the gumming applicator 1.

As indicated in FIG. 4 and in like manner to the example of FIG. 1 and FIG. 2, the nozzle 13 is rendered capable of movement in a direction D substantially parallel to the axis A of rotation of the discs 26 and 27, through the agency of actuator means 35, and translatable thus back and forth along the full axial length of the applicator 1, allowing the jet 14 to cover the longitudinal dimension of the peripheral gumming surface 6 in its entirety and consequently ensure a thorough cleaning action.

In practice, the nozzle 13 will have an orifice of diameter 0.02 mm or thereabouts and the fluid 50 will be supplied by the source 11 at a pressure of between 150 and 200 bar, in such a way that the jet 14 delivered by the nozzle 13 is atomized and able thus to guarantee an effective cleaning action without using an excessive quantity of fluid 50.

What is claimed is:

1. A device for cleaning a gumming applicator, comprising:

a source (11) of pressurized fluid (50) and at least one nozzle (13) connected to the source (11), producing at least one jet (14) of pressurized fluid (50) by which a gumming applicator (1) is invested when in operation in such a way as to remove residues (60) of an adhesive substance (2) from the selfsame gumming applicator (1);

a collection device (15) positioned in close proximity to the gumming applicator (1) and located beyond the nozzle (13) relative to the direction of rotation followed by the gumming applicator (1), in such a way as to admit the fluid (50) and the residues (60) of the adhesive substance (2); wherein said collection device (15) comprises:

a duct (16; 36) presenting an open inlet end **(16*a*; 38) positioned to admit the fluid (50) and the residues (60) of the adhesive substance (2), and an outlet end (16*b*; 41) from which the fluid (50) and the residues (60) of the adhesive substance (2)** are discharged;

a blower duct (19; 42) presenting a restriction (21) connected to the outlet end **(16*b*; 41) of the duct (16; 36)**;

a source (18) of pressurized gas connected by way of the blower duct (19; 42) to a holding tank (20) in which the adhesive substance (2) is collected; the source (18) of pressurized gas creating a depression in the restriction (21) of said blower duct (19; 42) to draw into the duct (16; 36) said adhesive substance (2).

2. A device as in claim 1, wherein the collection device (15) is capable of movement between a first operating position of close proximity to the gumming applicator (1), in which the fluid (50) and the residues (60) of the adhesive substance (2) are admitted, and a second idle position distanced from the gumming applicator (1).

3. A device as in claim 1, wherein the collection device (15) comprises a tank (24) positioned to catch the fluid (50) and the residues (60) of the adhesive substance (2) removed from the gumming applicator (1).

4. A device as in claim 1, wherein the nozzle (13) is capable of movement from one end of the gumming applicator (1) to another in such a way that the selfsame applicator (1) can be invested with fluid (50) along its entire longitudinal dimension.

5. A device as in claim 1, comprising actuator means (34) by which the nozzle (13) is set in motion from one end of the gumming applicator (1) to another in such a way as to invest the selfsame applicator (1) with fluid (50) along its entire longitudinal dimension.

6. A device as in claim 1, wherein the jet (14) of pressurized fluid (50) is projected mainly in a direction substantially tangential to the gumming applicator (1).

7. A device as in claim 1, wherein the jet (14) of pressurized fluid (50) is projected mainly in a substantially radial direction relative to the gumming applicator (1).

8. A device as in claim 1, wherein the nozzle (13) from which the pressurized fluid (50) is projected presents a micrometric orifice.

9. A device as in claim 1, wherein the fluid (50) is supplied from the source (11) at a pressure of substantially 150 bar.

10. A device as in claim 1, wherein the jet (14) of fluid (50) is an atomized jet.

* * * * *